US006883622B2

(12) United States Patent
Beaton et al.

(10) Patent No.: US 6,883,622 B2
(45) Date of Patent: Apr. 26, 2005

(54) METHOD FOR DRILLING A WELLBORE USING A BI-CENTER DRILL BIT

(75) Inventors: Timothy P. Beaton, The Woodlands, TX (US); Thomas L. Young, Perth (AU); David K. Truax, Houston, TX (US)

(73) Assignee: Smith International, Inc., Houston, TX (US)

( * ) Notice: Subject to any disclaimer, the term of this patent is extended or adjusted under 35 U.S.C. 154(b) by 32 days.

(21) Appl. No.: 09/888,328

(22) Filed: Jun. 22, 2001

(65) Prior Publication Data

US 2002/0017400 A1 Feb. 14, 2002

Related U.S. Application Data

(60) Provisional application No. 60/219,974, filed on Jul. 21, 2000.

(51) Int. Cl.[7] ..... E21B 10/26
(52) U.S. Cl. ..... 175/171; 175/57
(58) Field of Search ..... 75/57, 171, 257, 75/314, 320

(56) References Cited

U.S. PATENT DOCUMENTS 4,040,495 A 8/1977 Kellner et al. ..... 175/73
4,706,765 A * 11/1987 Lee et al. ..... 175/334
5,230,387 A 7/1993 Waters et al. ..... 175/45
5,423,389 A 6/1995 Warren et al. ..... 175/75
5,678,644 A * 10/1997 Fielder ..... 175/391
5,679,894 A 10/1997 Kruger et al. ..... 73/152.03
5,957,223 A * 9/1999 Doster et al. ..... 175/57
5,957,225 A * 9/1999 Sinor ..... 175/57
6,039,131 A * 3/2000 Beaton ..... 175/376
6,298,929 B1 * 10/2001 Cobos Rojas ..... 175/391
6,340,064 B2 * 1/2002 Fielder et al. ..... 175/385

FOREIGN PATENT DOCUMENTS

EP 0 467 580 A1 1/1992 ..... E21B/10/56

OTHER PUBLICATIONS

Gatline, Pertoleum Engineering, Prentice Hall Inc. 1960, pp142–145.*

European Search Report dated Nov. 6, 2003 (3 pgs.).

* cited by examiner

*Primary Examiner*—Frank Tsay
(74) *Attorney, Agent, or Firm*—Osha & May LLP

(57) ABSTRACT

A method is disclosed for drilling a wellbore. The method includes operating a turbine-type mud motor having a bi-center drill bit coupled to it, and applying an axial force to the bit which is selected so that the bit drills in a directionally stable manner. In one embodiment, the motor is a steerable motor operated to maintain a selected trajectory of the wellbore.

4 Claims, 1 Drawing Sheet

METHOD FOR DRILLING A WELLBORE USING A BI-CENTER DRILL BIT

CROSS-REFERENCE TO RELATED APPLICATIONS

This application claims the benefit of U.S. Provisional Patent No. 60/219,974, filed Jul. 21, 2000.

BACKGROUND OF INVENTION

1. Field of the Invention

The invention relates generally to the field of wellbore drilling methods and apparatus. More specifically, the invention relates to methods for drilling wellbores along a selected trajectory which are directionally stable.

2. Description of the Related Art

Wellbore drilling of earth formations for such purposes as petroleum extraction includes rotating a drill bit while applying axial force against the bit. Systems for applying the axial force and rotating the bit include drilling rigs which may directly rotate a string of drill pipe coupled to the drill bit. Alternatively or additionally, various types of hydraulically or pneumatically operated motors can be coupled to the bit. These so-called "mud motors" are operated by pumping drilling fluid through them. Generally, there are two basic types of mud motors. One type of motor is called "positive displacement". Positive displacement motors include a chambered stator in the interior of the motor housing which is usually lined with an elastomeric material, and a rotor which is rotationally coupled to the motor output shaft (and thence to the drill bit). Movement of drilling fluid through chambers defined between the stator and rotor causes the rotor to turn correspondingly to the volume of fluid pumped through the motor. The other type of mud motor is called "turbine", because the output of the motor is coupled to a turbine disposed inside the motor housing.

It is known in the art to drill a wellbore along a selected trajectory for the purpose of penetrating certain subsurface earth formations which are displaced from the surface location of the wellbore. Collectively, the techniques used to drill along such trajectories are known as directional drilling. Directional drilling includes using mud motors includes using motors having housings which are bent to a predetermined angle. These motors cause the trajectory of the wellbore to turn in the direction of the interior of the bend in the housing. One class of such motors is called "steerable", wherein the predetermined angle is about ½ degree. When the housing of a steerable motor is rotated by the drilling rig, drilling the wellbore progresses so as to substantially maintain the existing trajectory of the wellbore. This is called "rotating" or "rotary drilling".

To adjust the trajectory of the wellbore using a steerable motor, the rotation of the motor housing by the rig is stopped, and drilling continues only by the rotation of the motor output shaft. This is referred to as "slide drilling". As with other types of bent housing motors, slide drilling with a steerable motor causes the wellbore trajectory to turn in the direction of the bend in the motor housing.

It is very important in all types of directional drilling for the drilling assembly, including the drill bit, to be dynamically stable so that the selected trajectory will be maintained.

A particular type of drill bit, generally called a "bi-center" bit, has proven useful in certain drilling environments. A bi-center bit generally is characterized by having a "pass-through" diameter (the smallest diameter opening through which the bit will freely pass) which is smaller than the diameter of the hole drilled by such bits when they are rotated. Bi-center bits have proven useful, among other applications, when drilling through earth formations which are subject to swelling, or for drilling where it is desirable to be able to insert a pipe or casing in the drilled wellbore which has an outside diameter as close as possible to the inside diameter of a previously set casing.

Several types of bi-center drill bits are known in the art. One such bi-center bit is described in U.S. Pat. No. 5,678,644 issued to Fielder, for example. The bit shown in the Fielder '644 patent includes a pilot section, and a separate reaming section which drills a hole having the full drill diameter. Another type of bi-center bit is sold under the trade name "Steering Wheel Bi-Centrix", by Reed-Hycalog division of Schlumberger, Houston, Tex. Another type of bi-center bit is sold under the trade name Quad-D by Smith International, Inc., the assignee of this invention. These bits also have a pilot section and a reaming section. Another type of bi-center bit is known as "asymmetric" and does not include a separate reaming section, but instead has one side which conforms to a drill radius. The other side of the asymmetric bit conforms to a smaller radius to provide the bit with a pass-through diameter which is smaller than the drill diameter. One such asymmetric bit is sold under the trade name "X-TEND" by Smith International, Inc., the assignee of the present invention.

Bi-center bits have been difficult to use when directional drilling, because they can introduce directional instability in the drilling assembly when directional drilling. One reason for the instability is that it is not possible to use stabilizers in the drilling tool assembly near a bi-center drill bit. The instability is particularly noticed when drilling with mud motors, and more particularly, positive displacement mud motors. It is desirable to provide a drilling technique that is directionally stable when using mud motors with bi-center drill bits.

SUMMARY OF THE INVENTION

The invention is a method for drilling a wellbore. The method includes operating a turbine-type mud motor having a bi-center drill bit coupled to it, and applying an axial force to the bit which is selected so that the bit drills in a directionally stable manner. In one embodiment, the motor is a steerable motor operated to maintain a selected trajectory of the wellbore.

In another embodiment, the motor is either a bent housing motor or a steerable motor. The motor is operated to adjust the wellbore trajectory along a selected direction.

DETAILED DESCRIPTION

Figure 1:
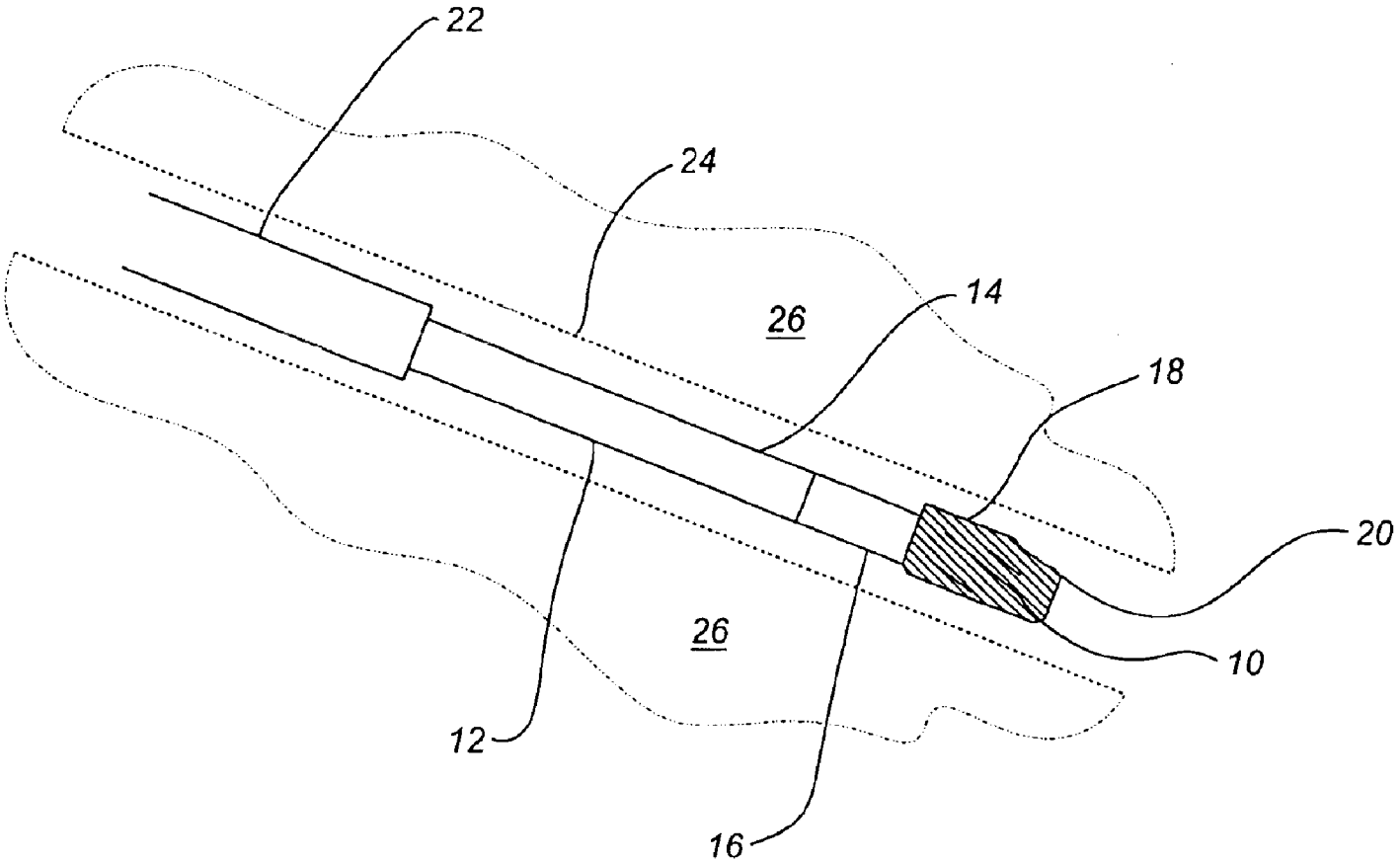
FIG. 1 shows a turbine motor coupled to a bi-center drill bit.

FIG. 1 shows a drilling tool assembly including a bi-center drill bit 10 coupled to a turbine-type mud motor 12. The motor 12 is coupled to a drill string 22, which may include heavy weight drill collars (not shown separately), drill pipe (not shown separately) and other devices known in the art to drill wellbores through earth formations. The wellbore being drilled is shown generally at 24 and the earth formations generally at 26.

In some embodiments of the invention, the motor 12 may be turned about its power section housing 14 by a drilling rig (not shown) disposed at the earth's surface in addition to having its bit box 16 be rotated by drilling fluid flow through the power section 14. In these embodiments, the motor 12 is generally a steerable motor, wherein the power section 14 includes a bend in the housing of about ½ degree. Other embodiments may use a motor having straight power section 14. Irrespective of the type of motor, the bit box 16 is rotated by drilling fluid flow through the power section 16.

The bi-center bit 10 shown in FIG. 1 includes a pilot section 20 and a separate reaming section 18. One such bit is sold under the trade name Quad-D by Smith International, Inc., the assignee of this invention. Alternatively, the bit 10 may be an asymmetric type such as one sold under the trade name "X-TEND" also by Smith International, Inc.

In the invention, the motor 12 is a turbine type because turbine motors operate at higher rotary speeds and consequently can operate at lower weight on bit than do positive displacement motors in order to achieve a comparable rate of penetration. As is known in the art, the rate at which a drill bit penetrates earth formation (the rate of penetration—"ROP") is related to both the axial force on the bit (weight on bit—"WOB") and the rotary speed of the bit.

Drilling with bi-center bits is more sensitive to WOB as a cause of deviation of the wellbore from a selected trajectory because stabilizers cannot be readily used with bi-center bits. This makes the drill string more susceptible to bowing and movement, which would otherwise be prevented when a stabilizer could be used. It is thought that the WOB needed with a positive displacement motor is above a level that will cause excessive deviation from the desired trajectory when drilling with a bi-center drill bit. Because a turbine can drill at higher RPM it can operate with a lower WOB to maintain a comparable ROP to a positive displacement motor.

It has been determined that drilling with a bi-center bit is more directionally stable at lower values of WOB than can be used without a turbine motor. Thus, the higher rotary speeds available using a turbine-type motor makes it possible to drill through earth formations with a bi-center bit at commercially acceptable ROP, while such drilling is more directionally stable. The improvement in directional stability makes it easier to drill a wellbore along a selected trajectory, using a steerable motor or bent-housing motor, for example.

The invention has been described in terms of certain embodiments. Those skilled in the art will devise other embodiments which do not depart from the spirit of the invention as disclosed herein. Accordingly, the invention shall be limited in scope only by the attached claims.

What is claimed is:

1. A method for drilling a wellbore, comprising:

operating a turbine-type mud motor selected from a bent housing turbine-type mud motor and a steerable turbine-type mud motor having a bi-center drill bit coupled thereto; and applying an axial force to the bit selected so that the bi-center drill bit drills in a directionally stable manner; and operating the turbine-type motor at a high rate of revolution so that the bi-center drill bit drills at greater than a selected rate of penetration.

2. The method of claim 1, wherein the bi-center bit comprises an asymmetric bit.

3. A method for drilling a wellbore, comprising:

operating a turbine-type mud motor selected from a bent housing turbine-type mud motor and a steerable turbine-type mud motor having a bi-center drill bit coupled thereto; and rotating the bi-center bit at a high rate of revolution such that the bit drills in a directionally stable manner.

4. An apparatus for drilling a wellbore, comprising:

a turbine-type mud motor selected from one of a bent housing turbine-type mud motor and a steerable turbine-type mud motor coupled to an asymmetric type drill bit.

* * * * *